US007013812B2

(12) United States Patent
Williams

(10) Patent No.: US 7,013,812 B2
(45) Date of Patent: Mar. 21, 2006

(54) TAMPING TOOL

(75) Inventor: Edward Williams, St. Louis, MO (US)

(73) Assignee: Ballast Tools, Inc., Crystal City, MO (US)

( * ) Notice: Subject to any disclaimer, the term of this patent is extended or adjusted under 35 U.S.C. 154(b) by 195 days.

(21) Appl. No.: 10/721,955

(22) Filed: Nov. 25, 2003

(65) Prior Publication Data

US 2005/0109235 A1 May 26, 2005

(51) Int. Cl.
*E01B 27/00* (2006.01)

(52) U.S. Cl. ..... 104/10; 104/13; 172/719; 37/104; 404/133.1

(58) Field of Classification Search ..... 104/2, 104/10, 11, 12, 13; 404/133, 133.1, 133.2, 404/133.05; 37/104, 105; 172/719
See application file for complete search history.

(56) References Cited

U.S. PATENT DOCUMENTS 1,452,990 A * 4/1923 Knox ..... 404/133.1
3,581,664 A 6/1971 Kruse
3,971,323 A * 7/1976 Beiswenger ..... 104/10
3,998,165 A 12/1976 Jaeggi
4,062,291 A 12/1977 Vick
4,068,594 A 1/1978 Crowell
4,160,419 A 7/1979 Stewart
4,404,913 A 9/1983 Theurer
4,445,438 A 5/1984 Theurer
4,501,200 A 2/1985 Delucia
4,563,953 A 1/1986 Theurer
4,922,828 A 5/1990 Theurer
5,048,425 A 9/1991 Theurer
5,125,145 A 6/1992 Williams
5,261,763 A * 11/1993 Crowell ..... 404/133.05
5,533,455 A 7/1996 Theurer
6,877,931 B1 * 4/2005 Theurer et al. ..... 404/133.05

* cited by examiner

*Primary Examiner*—Frantz F. Jules
(74) *Attorney, Agent, or Firm*—Storm LLP

(57) ABSTRACT

The present invention comprises a tamping tool comprising a shank and a blade, with the blade having various arrangements of wear-resistant material affixed to the face of the blade by means of brazing, soldering, gluing or other method. Additionally, some arrangements of the tamping tool have a wear-resistant tip inserted into a groove in the end of the blade. The tamping tool of the present invention reduces wear, providing an increased life and increasing the time intervals at which it becomes necessary to replace the tamping tool.

15 Claims, 5 Drawing Sheets

TAMPING TOOL

TECHNICAL FIELD

The invention relates to ballast tamping tools that are used on tamping machines for adjusting and leveling ballast under railway ties of railroad tracks.

BACKGROUND

Railroad tracks are typically supported by cross ties, typically made of wood, that run the width of the tracks, and are attached thereto by spikes. The cross ties rest upon ballast, which typically consists of gravel, crushed rocks or the like. The ballast typically shifts over time, with movement. Ballast tamping tools, which are machines that run along the railroad tracks, are used to tamp the ballast back into place around the cross ties so that the cross ties and the tracks attached thereto are adequately supported.

Ballast tamping tools have a reciprocating tamping drive, that move and vibrate shafts attached to the drive such that a pair of spaced-apart shafts, and the ballast blades, or paddles, attached to the other end of the shafts move towards and away from each other, tamping and compressing the ballast positioned under and around the cross ties. The ballast blades undergo a great deal of wear as a result of repeated contact with the ballast and edges of the cross ties, especially the face of the blade that is pressed against the ballast. When the blades wear out, chip, or snap off, they no longer perform the tamping task effectively, and must be replaced. To replace the shafts and/or attached blades necessitates shutting down the entire machine and removing the shaft(s) with worn or damaged blades. The necessity to shut down the equipment is obviously time-consuming, and reduces productive operating time for the equipment.

Therefore, what is needed is a system and method for enhancing the life of the blade to extend the interval at which blades must be replaced or repaired. A variety of devices and enhancements have been developed to help prolong the life of the ballast tamping tool shaft blade, or to simplify replacement of the blade.

For example, U.S. Pat. Nos. 3,581,664, 4,062,291 and 4,068,594 disclose tools in which the blade is secured to the end of the shaft with one or more screws so the blade can be easily removed when it has worn and needs to be repaired. However, in use, it was found that the vibrating motion of the tamping machine tended to loosen, or back out the screws such that the blades would detach from the shafts.

U.S. Pat. No. 4,160,419 discloses a system where the blade is rectangular and is gradually tapered from one side to the other so that the blade can sustain a greater amount of wear. However, this mechanism is complex, and must be opposed with a blade that is tapered in the opposite direction, necessitating more work and keeping multiple parts in stock.

U.S. Pat. No. 4,501,200 discloses a system that attaches the tamping blades to the shaft in a method that simplifies replacement of the blades, combined with blades having a hardened working face. However, this system requires replacement of the standard shaft with the special system of the patent.

U.S. Pat. No. 5,261,763 discloses a tool in which bits of hardened material have been attached to the blade. However, the hardened material is configured such that it has a ledge at the lower end which underlies the lower end of the blade. The configuration is such that the ledge of the hardened material is prone to catching on the ballast, detaching the hardened material from the underlying blade during use.

Thus, an on-going need exists for a tamping tool mechanism in which the necessity to replace the shaft blade is reduced or simplified.

SUMMARY

The present invention, accordingly, provides a tamping tool of the general character described in U.S. Pat. No. 5,261,763 which overcomes these and other difficulties.

In one embodiment of the present invention, a wedge-shaped tip with a rounded end made of wear-resistant material is inserted in the lower end of the blade, and wear-resistant material is placed along both faces of the of the blade to increase side wear. The shape of the tip transfers impact into the body of the blade, to increase life.

In another embodiment of the present invention, pieces of wear-resistant material have been placed along the face of the blade, including a very thick piece at the top of the blade, where it adjoins the shaft, which improves the life of the blade. Additionally, large pieces of wear-resistant material with a rounded edge are attached at the tip of the blade, with additional wear-resistant material on the rear side of the blade to improve impact resistance and wear.

In yet another embodiment of the present invention, a tip shaped like an opened parachute made of wear-resistant material is inserted in the lower end of the blade. This shape protects the end of the tip area and the pieces of wear-resistant material attached to the side of the blade. This shape provides extra protection such that if the wear-resistant material on the side of the blade and the blade body wear through, the portion of the parachute tip inserted up into the blade will be what comes in contact with the ballast, to provide additional life for the blade.

In a further embodiment of the present invention, the arrangement of the tool has the shank slightly off-set from center, and has wear-resistant material on both faces of the blade so that one blade can be used in either position by rotating it 180 degrees in the tool shaft holder. When one face of the blade has worn, it can be rotated and swapped with a blade from the other side of the tamping tool for continued use.

Although it is known that facing a tool with wear-resistant hardened material, such as tungsten carbide, can increase the life of the tool, the results seen with the arrangements of wear-resistant material of the present invention yielded an unexpected increase in wear life of 25 to 75 times the life of uncoated blades.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
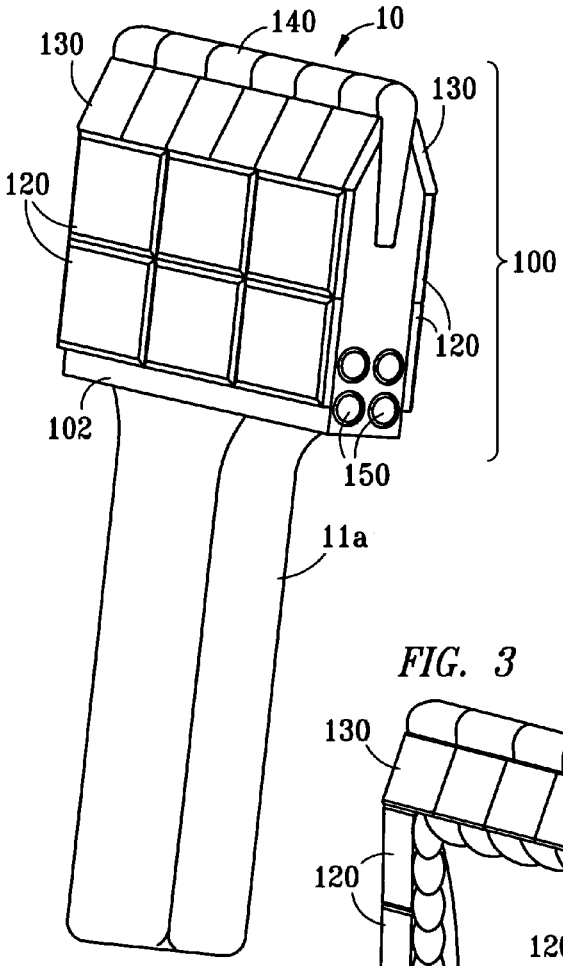
FIG. 1 is a front elevation view of a first arrangement of a tamping tool blade of the present invention.

In the discussion of the FIGURES the same reference numerals will be used throughout to refer to the same or similar components. In the interest of conciseness, various other components known to the art, such as tamping machines, rails, ties and spikes, have not been shown or discussed.

Figure 2:
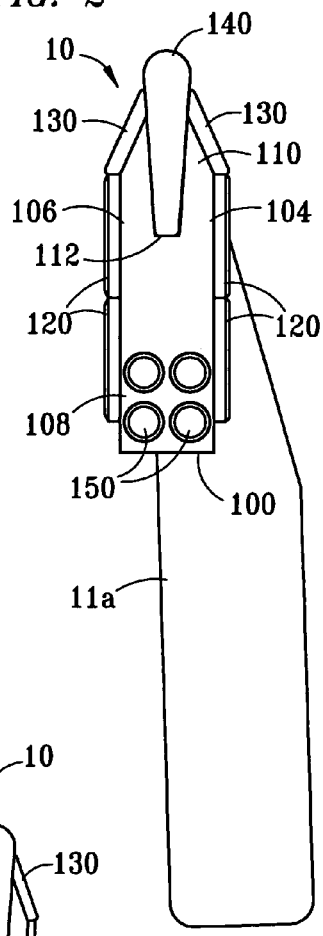
FIG. 2 is an side view of the system of FIG. 1 taken along the line 2—2 of FIG. 1.
Figure 3:
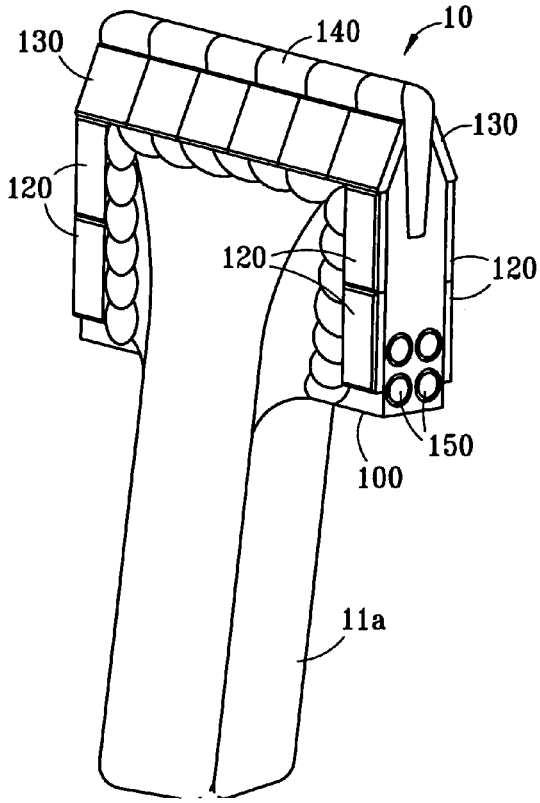
FIG. 3 is a rear elevation view of a first arrangement of a tamping tool blade of the present invention.

Referring to FIGS. 1, 2, and 3 of the drawings, the reference numeral 10 generally designates a tamping tool of the present invention, which comprises a shank 11*a*, and a blade 100 that is welded to the lower end of the shank 11*a*, or is forged as a single unit with the shank 11*a*. As can be clearly seen in FIG. 3, the end of the shank 11*a* at the blade 100 bulges out slightly before tapering down near the end of the blade 100. This shape provides strength and structural integrity to the shank 11 and blade 100.

The body 102 of the blade 100 is typically formed of a metal, such as steel, iron or the like, but can be made of other materials as well. The blade 100 has a front face 104, a rear face 106, a top 108, a tapered, or slanted bottom 110 and a bottom end 112. Typically, the blade 100 is about 2–6 inches long, about 2–6 inches wide, and about ¾ inch thick at the top 108, tapering to the bottom end 112. The blade 100 has tiles 120 of a wear-resistant material, such as tungsten carbide or the like, secured to the faces 104, 106 of the blade 100 at the top 108 of the blade 100. In some configurations of this arrangement of the present invention, wear-resistant tiles 122 are secured to the bottom portion of the shank 11*a* for longer wear. Each tile 120 is preferably about 0.125 inches thick for long wear. The blade also has one or more other tiles 130 of wear-resistant material secured to the faces 104, 106 of the blade 100 near the bottom 110. Each tile 130 is preferably about 0.125 inches thick for long wear. The tiles 130 protect the slanted bottom 110 portion of the blade 100. The bottom end 112 has a groove cut down into the blade 100.

A tip 140, which is shaped like a parachute or an elongated tear, is inserted into the groove in the bottom end 112, with the rounded tear projecting outward. The shape of the tip 140 is designed to absorb impact and transfer it into the body of the tool 10. The tip 140 is made of a wear-resistant material, such as tungsten-carbide. Multiple smaller tips 140 of wear-resistant material having an elongated shape can also be inserted in the groove adjacent to each other to fill in the entire groove, rather than a single continuous tip 140.

One or more pins 150 are inserted into the body 102 near the top 108. The pins 150, are typically made of a wear-resistant material and run through the width of the body 102 to provide increased strength to the body 102, which increases the life of the tiles 120, 122, 130 attached to the body 102. The tiles 120, 122, 130, tip 140, and pins 150 are attached to the body 102 by means of brazing, soldering, gluing or other appropriate means.

Figure 4:
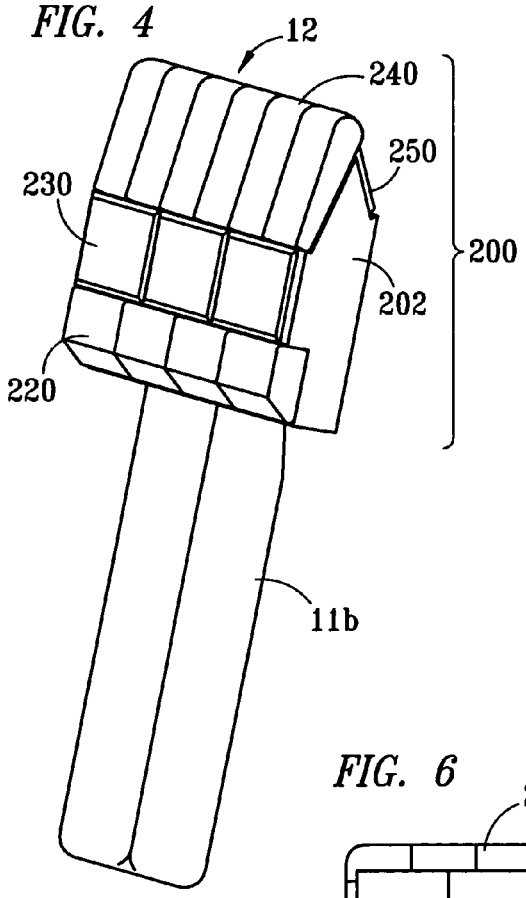
FIG. 4 is a front elevation view of a second arrangement of a tamping tool blade of the present invention.
Figure 5:
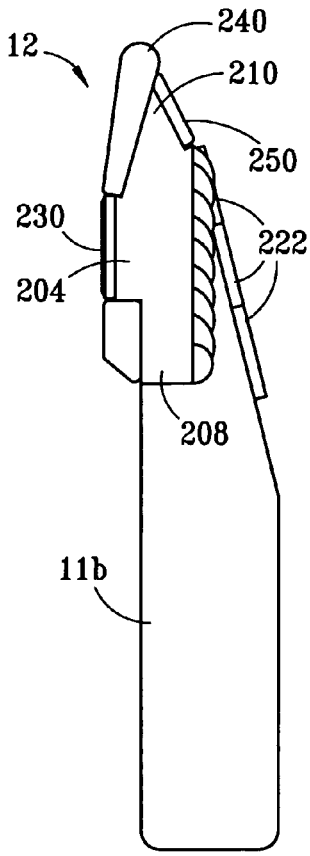
FIG. 5 is an side view of the system of FIG. 4 taken along the line 5—5 of FIG. 4.
Figure 6:
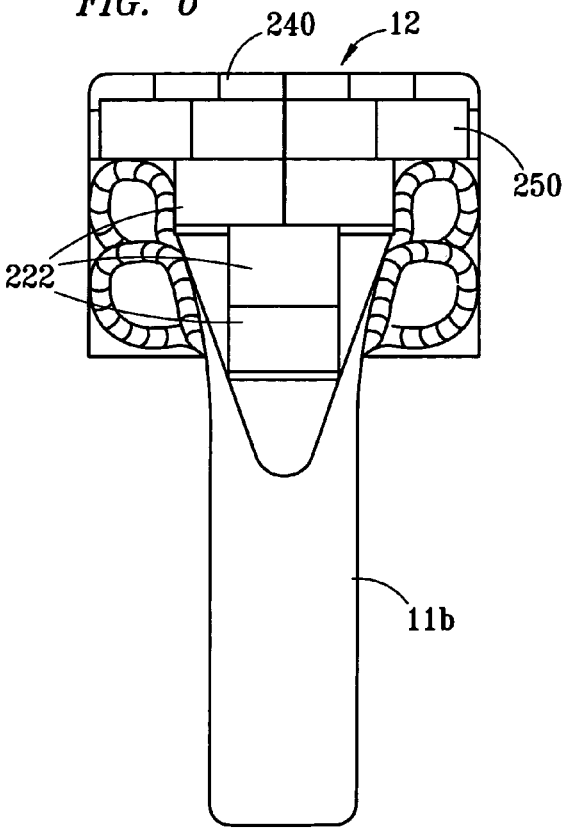
FIG. 6 is a rear elevation view of a second arrangement of a tamping tool blade of the present invention.

Referring to FIGS. 4, 5, and 6 of the drawings, a second embodiment of the present invention is shown, in which the reference numeral 12 generally designates a tamping tool of the present invention, which comprises a shank 11*b*, and a blade 200 that is welded to the lower end of the shank 11*b*, or is forged as a single unit with the shank 11*b*. As can be clearly seen in FIG. 6, the end of the shank 11*b* at the blade 200 bulges out slightly before tapering down near the end of the blade 200. This shape provides strength and structural integrity to the shank 11*b* and blade 200. The shank 11*b* can be centered on the rear face 206 of the blade 200 as shown in FIG. 6, or it can be positioned to the left or right of center (not shown), depending on the arrangement of tamping equipment the tamping tool 12 will be used with.

The body 202 of the blade 200 is typically formed of metal, such as iron or steel, but can be made of other materials as well. The blade 200 has a front face 204, a rear face 206, a top 208, a slanted bottom 210 and a bottom end 212. Typically, the blade 200 is about 2 to 6 inches long, about 2–6 inches tall, and about ¾ inches thick at the top 208, tapering toward the bottom end 212. The blade 200 has tiles 220 of a wear-resistant material secured to the front face 204 of the blade 200 at the extreme upper portion of the top 208 of the blade 200. Each tile 220 is preferably about ⅜ inches thick for long wear. The blade 200 also has another layer of wear-resistant tiles 230 secured to the front face 204 of the top 208 of the blade. Each tile 230 is preferably about 0.125 inches thick for long wear. In some configurations of this arrangement of the present invention, wear-resistant tiles 222 are secured to the bottom portion of the shank 11*b* for longer wear.

The blade also has additional wear-resistant tiles 240 secured to the front face 204 of the bottom 210 of the blade. The tile 240 protects the slanted bottom 210 portion of the blade 200. The tile 240 is rounded at the end near the bottom 212 of the blade to minimize edge wear at the part of the strip 240 that impacts down into the ballast, and eliminate edges that could catch in the ballast and be torn off of the blade 200, as in the prior art. The tile 240 can be a single tile extending across the entire face of the blade, multiple smaller tiles 240 can be secured to the blade to cover the entire face of the blade.

The blade 200 can also have another layer of wear-resistant tiles 250 secured to the rear face 206 of the bottom 210 of the blade. The tiles 250 protect the slanted rear bottom 210 portion of the blade 200, which absorbs the impact when the blade 200 is compressing the ballast inwards. This portion of the blade 200 also comes in contact with the ballast when the blade 200 is being pulled back from compacting the ballast under the cross ties (not shown). The tiles 250 reduce the wear frequently seen on this portion of the blade 200. Each tile 250 is preferably about 0.125 inches thick for long wear. The tiles 220, 230, 240 and 250 are attached to the body 102 by means of brazing, soldering, gluing or other appropriate means.

Figure 7:
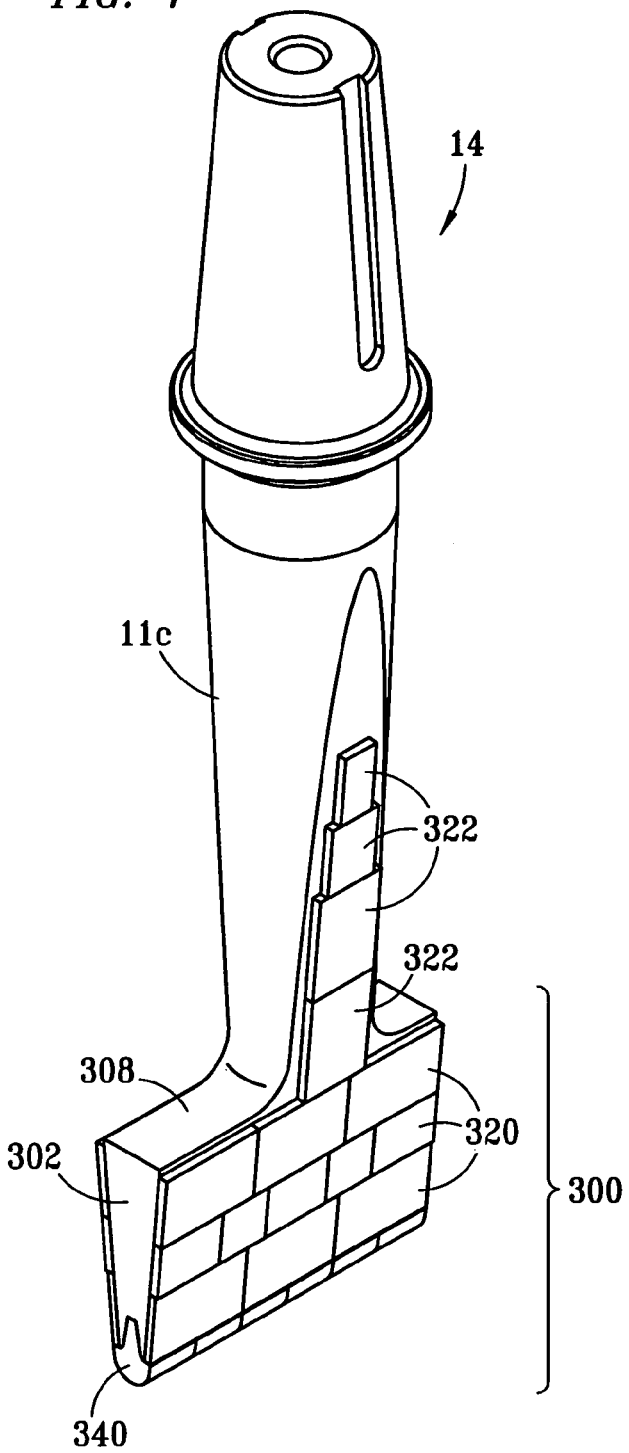
FIG. 7 is a front elevation view of a third arrangement of a tamping tool blade of the present invention.
Figure 8:
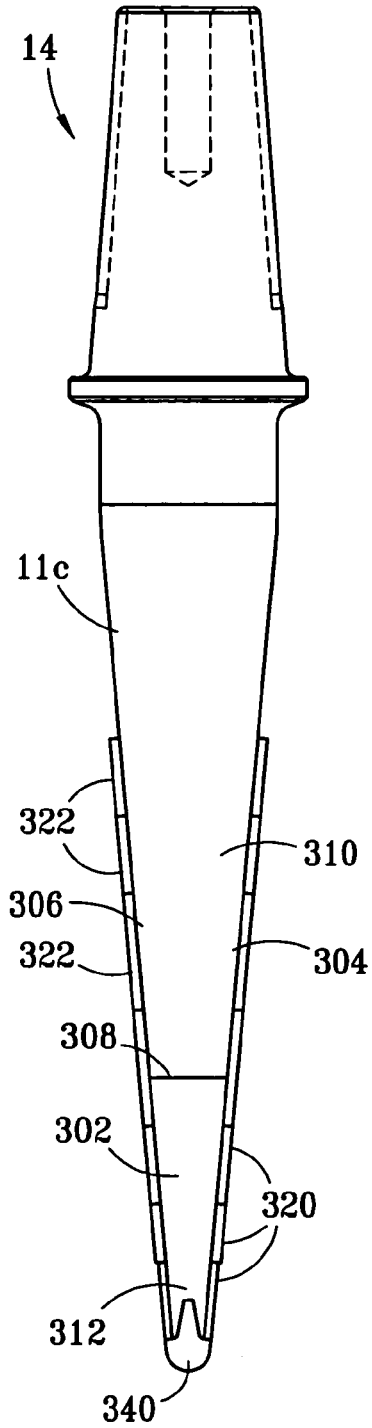
FIG. 8 is an side view of the system of FIG. 7 taken along the line 8—8 of FIG. 7.

Referring to FIGS. 7, and 8 of the drawings, the reference numeral 14 generally designates a tamping tool of the present invention, which comprises a shank 11*c*, and a blade 300 that is welded to the lower end of the shank 11*c*, or is forged as a single unit with the shank 11*c*. This arrangement of the present invention is intended for use in tamping equipment that utilize tamping tools 14 configured with the shank 11*c* positioned to the left or right of center. Because this arrangement of the tool 14 in the present invention has wear-resistant material 320, 322 on both faces of the blade 300, one tool 14 can be used in either position by rotating it 180 degrees in the tool shaft holder (not shown). This eliminates the need to keep multiple parts in stock. Additionally, when one face of the tamping tool 14 has worn, it can be rotated and swapped with a tamping tool 14 from the other side of the tamping equipment for continued use. This results in a life that is twice as long for this arrangement of tamping tool 14.

The body 302 of the blade 300 is typically formed of metal, such as iron or steel, but can be made of other materials as well. The blade 300 has a front face 304, a rear face 306, a top 308, a bottom 310 and a bottom end 312. Typically, the blade 300 is about 2 to 6 inches long, about 2–6 inches tall, and about ¾ inches thick at the top 308, tapering toward the bottom end 312. The bottom end 312 has a groove cut down into the blade body.

The blade 300 has tiles 320 made of a wear-resistant material, such as tungsten-carbide, secured to the entire surface of the front and rear faces 304, 306 of the blade 300. Each tile 320 is preferably about 0.125 inch thick for increased wear resistance. Additionally, wear-resistant tiles 322 are secured to the bottom portion of the shank 11*c* for longer wear.

Figure 15:
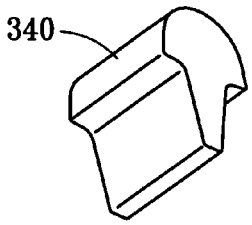
FIG. 15 is a detailed view of the tip used in the arrangements of the present invention shown in FIGS. 7–14.

A tip 340, which is shaped like a mushroom, or a "T" with a rounded top, made of a wear-resistant material, is inserted into the groove in the bottom end 312 of the blade 300, with the rounded top projecting outward. The shape of the tip 340 is designed to absorb impact and transfer it into the body of the tool 14. Multiple smaller tips 3140 of wear-resistant material can also be inserted in the groove adjacent to each other to fill in the entire groove, rather than a single continuous tip 340. FIG. 15 shows a detailed view of the tip 340 of this arrangement of the present invention.

The tiles 320, 322, and tip 340 are attached to the shank 11, and body 302 by means of brazing, soldering, gluing or other appropriate means.

Figure 9:
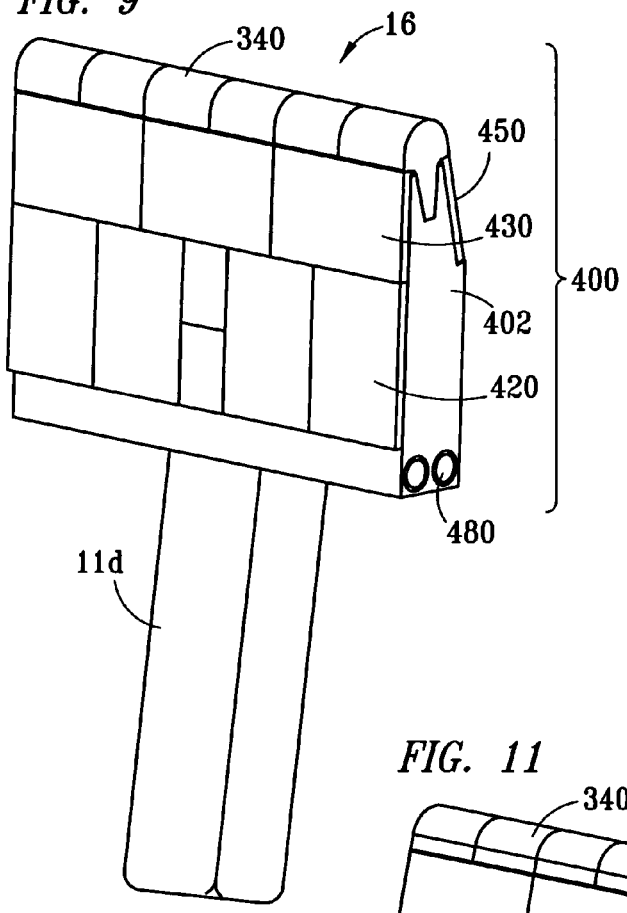
FIG. 9 is a front elevation view of a fourth arrangement of a tamping tool blade of the present invention.
Figure 10:
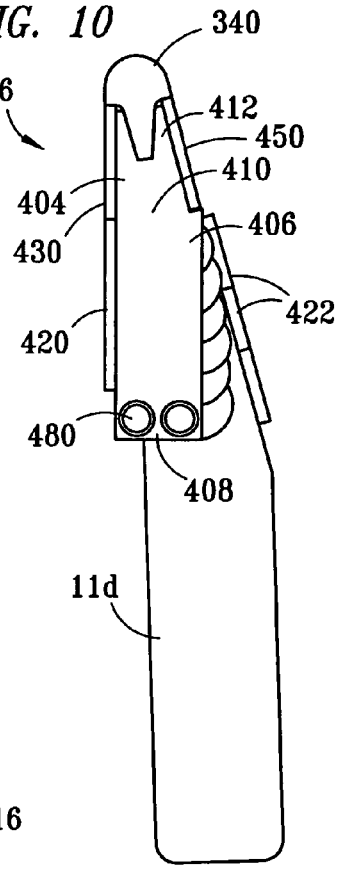
FIG. 10 is an side view of the system of FIG. 9 taken along the line 10—10 of FIG. 9.
Figure 11:
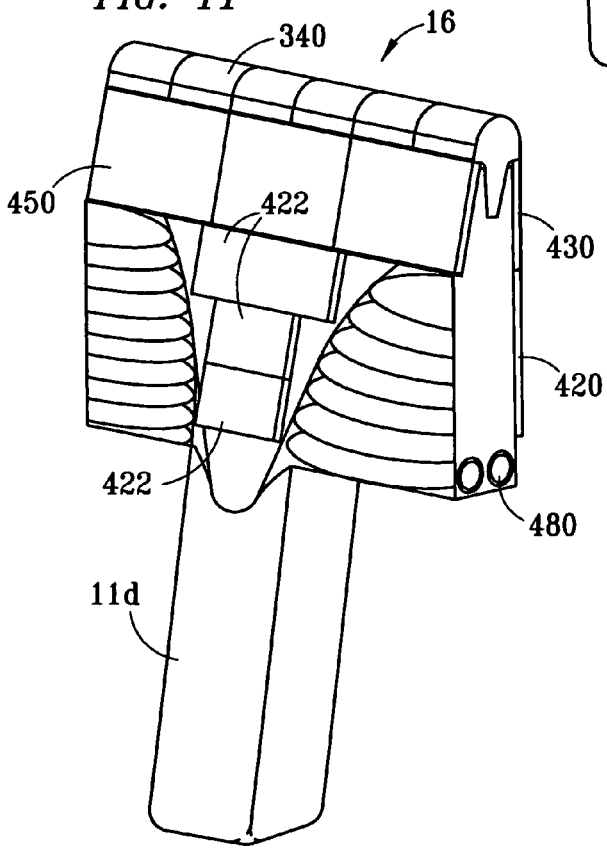
FIG. 11 is a rear elevation view of a fourth arrangement of a tamping tool blade of the present invention.

Referring to FIGS. 9, 10, and 11 of the drawings, the reference numeral 16 generally designates a tamping tool of the present invention, which comprises a shank 11*d*, and a blade 400 that is welded to the lower end of the shank 11*d*, or is forged as a single unit with the shank 11*d*.

The body 402 of the blade 400 is typically formed of metal, such as iron or steel, but can be formed from other materials as well. The blade 400 has a front face 404, a rear face 406, a top 408, a bottom 410 and a bottom end 412. Typically, the blade 400 is about 2 to 6 inches long, about 2–6 inches tall, and about ¾ inches thick at the top 408, tapering toward the bottom end 412. The blade 400 has tiles 420 of a wear-resistant material, such as tungsten-carbide, secured to the front face 404 of the blade 400 at the top 408 of the blade 400. Each tile 420 is preferably about 0.125 inch thick for increased wear resistance.

The blade also has wear-resistant tiles 430 of hardened material secured to the front face 404 of the bottom 410 of the blade. The tile 430 protects the bottom 410 portion of the blade 400. Each tile 430 is preferably about 0.125 inches thick for long wear.

The bottom end 412 has a groove cut down into the blade 400. A tip 340, which is shaped like a mushroom or a "T" with a rounded top, made of a wear-resistant material is inserted into the groove in the bottom end 412, with the rounded top projecting outward. Multiple smaller tips 340 of wear-resistant material can also be inserted in the groove adjacent to each other to fill in the entire groove, rather than a single continuous tip 340. The shape of the tip 340 is designed to absorb impact and transfer it into the body of the tool 16. FIG. 15 shows a detailed view of the tip 340 of this arrangement of the present invention.

The blade 400 can also have wear-resistant tile 450 secured to the rear face 406 of the bottom 410 of the blade. The tiles 450 protect the slanted rear bottom 410 portion of the blade 400, which absorbs the impact when the blade 400 is compressing the ballast inwards. This portion of the blade 400 also comes in contact with the ballast when the blade 400 is being pulled back from compacting the ballast under the cross ties (not shown). The tile 450 reduces the wear frequently seen on this portion of the blade 400. Each tile 450 is preferably about 0.125 inches thick for long wear. Additionally, wear-resistant tiles 422 can be secured to the bottom portion of the shank 11*d* for longer wear.

One or more pins 480 made of a wear-resistant material are inserted into the blade body 402 near the top 408. The pins 480 run through the width of the body 402 to provide increased strength to the body 402, which increases the life of the tiles 420, 422, 430, and 450 attached to the body 402. The wear-resistant tiles 420, 422, 430, 450, tip 340, and pins 480 are attached to the blade body 402 by means of brazing, soldering, gluing or other appropriate means.

Figure 12:
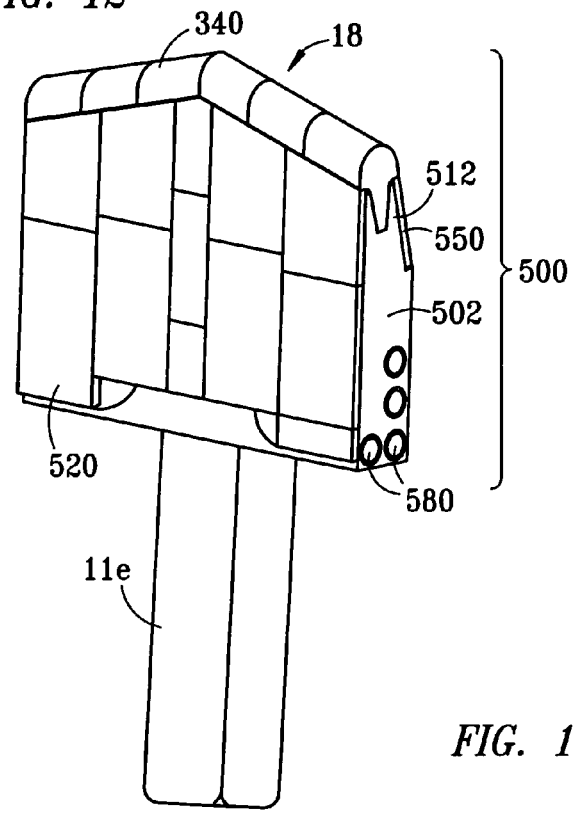
FIG. 12 is a front elevation view of a fifth arrangement of a tamping tool blade of the present invention, which is a variation of the fourth arrangement.
Figure 13:
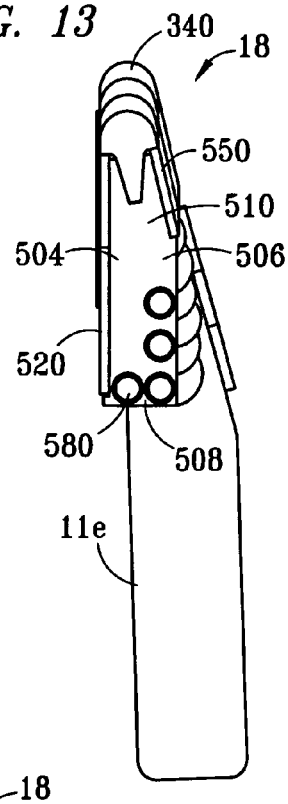
FIG. 13 is an side view of the system of FIG. 12 taken along the line 13—13 of FIG. 12.
Figure 14:
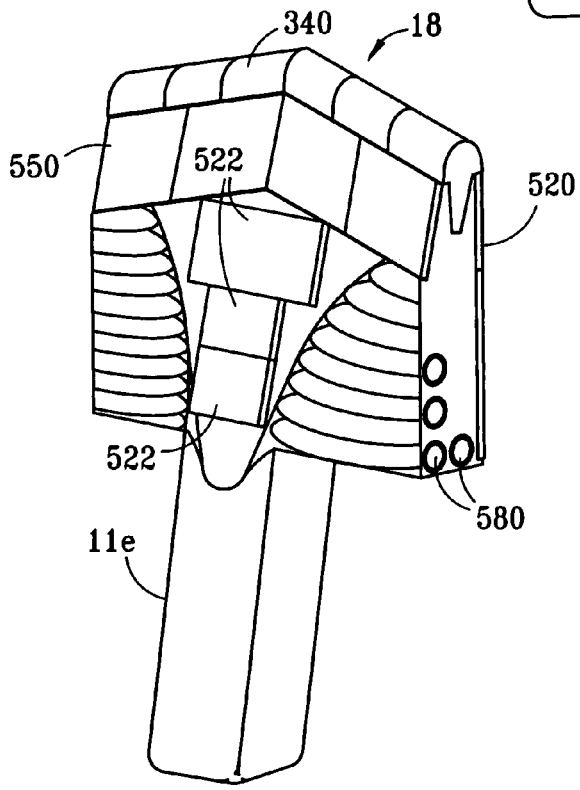
FIG. 14 is a rear elevation view of a fifth arrangement of a tamping tool blade of the present invention.

The embodiment of FIGS. 12, 13, and 14 is similar to the embodiment of FIGS. 9, 10, and 11. According to the embodiment of FIGS. 12, 13, and 14, the bottom end 512 is configured to taper up to a point in the center, rather than being essentially flat across the bottom.

Referring to FIGS. 12, 13, and 14 of the drawings, the reference numeral 18 generally designates a tamping tool of the present invention, which comprises a shank 11*e*, and a blade 500 that is welded to the lower end of the shank 11*e*, or is forged as a single unit with the shank 11*e*.

The body 502 of the blade 500 is typically formed of metal, such as steel or iron, but can be formed from other materials, as well. The blade 500 has a front face 504, a rear face 506, a top 508, a bottom 510 and a bottom end 512. Typically, the blade 500 is about 2 to 6 inches long, about 2–6 inches tall, and about ¾ inches thick at the top 508, tapering toward the bottom end 512. AS can be seen, the bottom end 512 of the blade 500 comes to a peak or apex in the center of the blade, and tapers downwards from the tip toward both edges. The blade 500 has wear-resistant tiles 520 of various sizes secured to the front face 504 of the blade 500 at the top 508 of the blade 500. Each strip of wear-resistant material 520 is preferably about 0.125 inch thick for increased wear resistance.

The bottom end 512 has a groove cut down into the blade 500. A tip 340, which is shaped like a mushroom or a "T" with a rounded top, is inserted into the groove in the bottom end 512, with the rounded top projecting outward. Multiple smaller tips 340 of wear-resistant material can also be inserted in the groove adjacent to each other to fill in the entire groove, rather than a single continuous tip 340. The shape of the tip 340 is designed to absorb impact and transfer it into the body of the tool 18. FIG. 15 shows a detailed view of the tip 340 of this arrangement of the present invention.

The blade 500 also has another wear-resistant strip 550 secured to the rear face 506 of the bottom 510 of the blade. The strip 550 protects the slanted rear bottom 510 portion of the blade 500, which absorbs the impact when the blade 500 is compressing the ballast inwards. This portion of the blade 500 also comes in contact with the ballast when the blade 500 is being pulled back from compacting the ballast under the cross ties (not shown). The wear-resistant strip 550 reduces the wear frequently seen on this portion of the blade 500. Each wear-resistant strip 550 is preferably about 0.125 inches thick for long wear. Additionally, wear-resistant tiles 522 are secured to the bottom portion of the shank 11*e* for longer wear.

One or more pins made of a wear-resistant material 580 are inserted into the blade body 502 near the top 508. The pins 580 run through the width of the body 502 to provide increased strength to the body 502, which increases the life of the tiles 520, 522, and 550 attached to the body 502. The tiles 520, 522, 550, tip 340, and pins 580 are attached to the blade body 502 by means of brazing, soldering, gluing or other appropriate means.

FIG. 15 shows a detailed view of the tip 340 used in the embodiments of the present invention shown in FIGS. 7–14. As can be seen, the tip 340 is shaped like a mushroom, with a rounded top, and a leg that is tapered inward from the top to a flat bottom.

In addition to the advantages described above with respect to the previous embodiment, the alternate embodiment. It is understood that the present invention can take many forms and embodiments. Accordingly, several variations may be made in the foregoing without departing from the spirit or the scope of the invention.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A railroad ballast tamping tool comprising:

a) a blade having a height, a width and a depth, being substantially rectangular in shape, the blade tapering at a bottom end and having a groove cut into the bottom end of the blade across the width, a front side of the blade having a layer of tiles of a wear-resistant material secured thereto, overlaying substantially the entire front side of the blade;

b) a tip of tiles of a wear-resistant material having a "T" shape with a rounded top being secured in the groove along the bottom width of the blade, such that the rounded top projects below the bottom end of the blade; and c) at least one pin secured into a hole running through the width of the blade at a top end; and d) a substantially cylindrical shank having an upper end capable of being attached to a tamping machine, and a lower end that tapers, the tapered portion being attached to the top end of the blade.

2. The tamping tool of claim 1 further comprising tiles of wear-resistant material secured to at least a portion of the rear side of the blade.

3. The tamping tool of claim 1 further comprising tiles of wear-resistant material secured to the side of the tapered portion of the shank not attached to the rear side of the blade.

4. The tamping tool of claim 1 wherein the shank is welded to the top rear side of the blade.

5. The tamping tool of claim 1 wherein the shank and the blade are made from a single unit.

6. The tamping tool of claim 1 wherein the bottom end of the blade and the tip of tiles form a V-shape with the point in the center of the bottom end of the blade.

7. The tamping tool of claim 1 wherein the tiles are secured to the tool by means of gluing, soldering, brazing, or welding.

8. A railroad ballast tamping tool comprising:

a) a blade having a height, a width and a depth, being substantially rectangular in shape, the blade tapering at a bottom end and having a groove cut into the bottom end of the blade across the width, a front side of the blade having a layer of tiles of a wear-resistant material secured thereto, overlaying substantially the entire front side of the blade;

b) a tip of tiles of a wear-resistant material having a "T" shape with a rounded top and a tapered bottom being secured in the groove along the bottom width of the blade such that the rounded top of the tile projects below the bottom end of the blade; and c) a substantially cylindrical shank having an upper end capable of being attached to a tamping machine, and a lower end that tapers, the tapered portion being attached to a top end of the blade.

9. The tamping tool of claim 8 further comprising tiles of wear-resistant material secured to at least a portion of a rear side of the blade.

10. The tamping tool of claim 8 further comprising tiles of wear-resistant material overlaying substantially an entire rear side of the blade.

11. The tamping tool of claim 8 further comprising tiles of wear-resistant material secured to the tapered portion of the shank.

12. The tamping tool of claim 8 further comprising tiles of wear-resistant material secured to the side of the tapered portion of the shank not attached to the rear side of the blade.

13. The tamping tool of claim 8 wherein the shank is welded to the top rear side of the blade.

14. The tamping tool of claim 8 wherein the bottom end of the blade and the tip of tiles form a V-shape with the point of the "V" in the center of the bottom end of the blade.

15. The tamping tool of claim 8 further comprising at least one pin secured into a hole running through the width of the blade at a top end.

* * * * *